US005803583A

United States Patent [19]

Hsieh

[11] Patent Number: 5,803,583

[45] Date of Patent: Sep. 8, 1998

[54] PEN WITH LIGHT-EMITTING MEANS

[76] Inventor: Chi-Li Hsieh, No. 8, Alley 1, Lane 76, Sec. 2, Li Shyng Road, Dan Chorng City, Taipei County, Taiwan

[21] Appl. No.: 688,971

[22] Filed: Jul. 31, 1996

[51] Int. Cl.[6] ..... B43K 29/10

[52] U.S. Cl. ..... 362/118; 362/184; 401/195

[58] Field of Search ..... 362/118, 184, 362/234, 253; 401/195

[56] References Cited

U.S. PATENT DOCUMENTS

| | | | |
|---|---|---|---|
| 5,131,775 | 7/1992 | Chen | 362/118 |
| 5,405,208 | 4/1995 | Hsieh | 362/118 |
| 5,544,967 | 8/1996 | Yao | 362/118 |

*Primary Examiner*—Alan Cariaso

*Attorney, Agent, or Firm*—Morton J. Rosenberg; David I. Klein; Jun Y. Lee

[57] ABSTRACT

A pen with a light source has a head member with a bulb connected thereto and an adjusting assembly and batteries mounted in tube members. When the adjusting assembly is turned to adjust the position of an ink tube of the pen, the bulb in the head member is energized to allow writing in a dark place. The pen also includes an IC board mounted in an upper portion of the pen. When a push-button switch of the IC board is depressed, a light source mounted therein emits light which passes through a focusing ring above the IC board for emitting a beam of light through a hole on a top of the pen, serving as a luminous pointer.

6 Claims, 5 Drawing Sheets

PEN WITH LIGHT-EMITTING MEANS

BACKGROUND OF THE INVENTION

A pen is still a very convenient and important writing means even though a computer has been used to largely replace the writing by hands. A drawback existed in the conventional pens is the pens can not be conveniently used in a dark environment. There are attempts to associate a mini flashlight with a pen. However, the design causes the pen to have larger volume and the pen is therefore not suitable for holding by hand and becomes inconvenient in writing or carrying. Since such conventional pen with mini flashlight is not practical and convenient in use, it is prevented from being widely accepted by the consumers.

It is therefore tried by the inventor to develop a pen which provides a user with the writing and the lighting functions at the same time while the pen has the same small volume for convenient holding by a hand.

SUMMARY OF THE INVENTION

A Primary object of the present invention is to provide a pen with light-emitting means which provides lighting function without sacrificing the basic writting function of a pen.

The pen with light-emitting means according to the present invention to achieve the above object mainly includes a head member, an ink tube and tube members as well as an adjusting assembly, springs, and conductive ring disposed inside the tube members to complete a pen which can be easily operated to provide a user with good lighting when necessary.

Another object of the present invention is to provide a pen in which an IC board, a focusing ring and a push-button switch are provided to form a light source in the pen. The light source emits light which passes the focusing ring to emit from a through hole on a top of the pen in a form of light beam, serving as a light indicating means, so that the pen with light emitting means of the present invention can be used in dark place or in the night or be used as an aid in teaching or show to provide an indicating light.

DETAILED DESCRIPTION OF THE PREFERRED EMBODIMENTS

Figure 1:
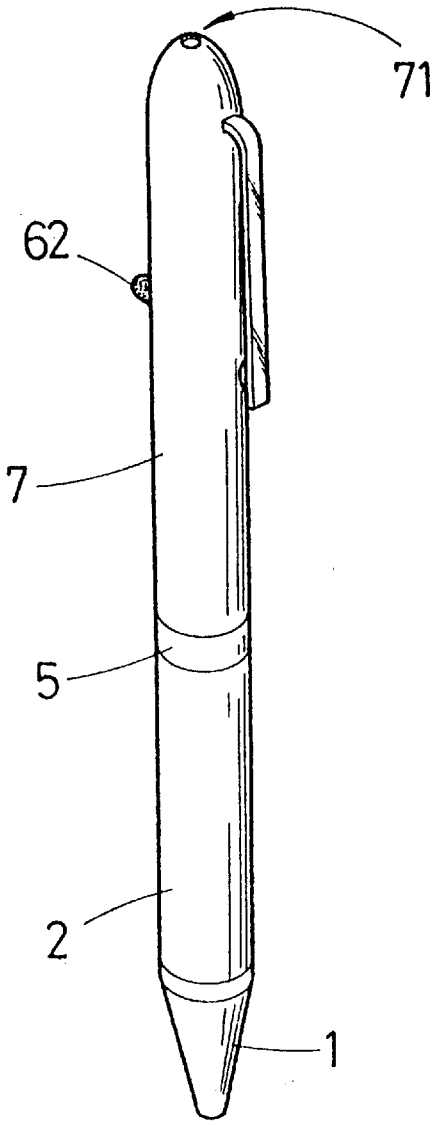
FIG. 1 is a perspective view showing the appearance of a pen with light-emitting means according to the present invention.

Please refer to the figures for the detailed structure of the present invention. Same numeral is designated to the same part in different drawings.

The pen with light-emitting means according to the present invention is generally referenced by letter A. The pen with light-emitting means A mainly includes a head member 1, a lower tube member 2, an ink tube 3 made of non-metal material, an adjusting assembly 4, an ornamental ring 5, an IC board, an upper tube member 7, a bulb 8, and batteries 9, 91.

The head member 1 is made of transparent material and has a conic hollow lower portion and a hollow cylindrical upper retaining portion 11 with a certain predetermined peripheral wall thickness. An annular conductive ring 13 is disposed in a retaining recess 12 defined by the peripheral wall of the cylindrical upper retaining portion 11. As more clear shown in FIG. 4, a bulb recess is formed between the retaining portion 11 and the retaining recess 12 at proper position for receiving the bulb 8 therein. A positive electrode wire 81 and a negative electrode wire 82 of the bulb 8 are directed to an outer periphery of the upper retaining portion 11 and an inner side of the retaining recess 12, respectively.

The lower tube member 2 is a metal tube with adequate length. An inner lower end of the lower tube member 2 fitly engages with the outer periphery of the upper retaining portion 11 of the head member 1 and has the function to electrically connect the positive electrode wire 81 of the bulb 8. An upper end of the lower tube member 2 has an inner diameter which fitly engages with and receives the adjusting assembly 4 therein.

The adjusting assembly 4 includes a sleeve member 41 which is mounted in the upper portion of the lower tube member 2 in a tight fit relation, an internally threaded ring member 42 tightly clamped to a lower end of the sleeve member 41, a movably adjustable hollow insulator 43 disposed inside the sleeve member 41 with an externally threaded tubular lower end thereof engaged with the internally threaded ring member 42, an ink tube holder 44 extending through the hollow insulator 43 and having an externally threaded upper end which engages with an internally threaded upper end of the insulator 43, a hemispherical conductive body 45 connected to the upper end of the ink tube holder 44, a spring 47 put around the ink tube 3 with one end thereof fixedly engaged into an annular groove 46 formed near a lower end of the ink tube holder 44 which extends through the sleeve member 41 and screws into the insulator 43 with the non-metal ink tube 3 inserted therein, and the battery 9 is disposed on a top of the conductive body 45.

The ornamental ring 5 is disposed between the lower tube member 2 and the upper tube member 7, a middle portion thereof is an insulator 51, separating the ornamental ring 5 into a top and a bottom receiving space 52 and 53, respectively.

The upper tube member 7 is also a metal tube with adequate length and has a through hole 71 formed on a top end thereof. A lower end of the upper tube member 7 is screwed to the ornamental ring 5. The IC board 6 is fitly mounted in the upper tube member 7 and is located just below a focusing ring 63. The focusing ring 63 is a annular member having a focusing glass. The IC board 6 has a lower base 61 which presses against a spring 65 disposed between the base 61 and the batteries 91. An opening is formed on the upper tube member 7 at a position corresponding to a push-button switch 62 of the IC board 6 for the push-button switch 62 to project therefrom. The IC board carries a light source 66 and an integrated circuit driver circuit 67.

Figure 2:
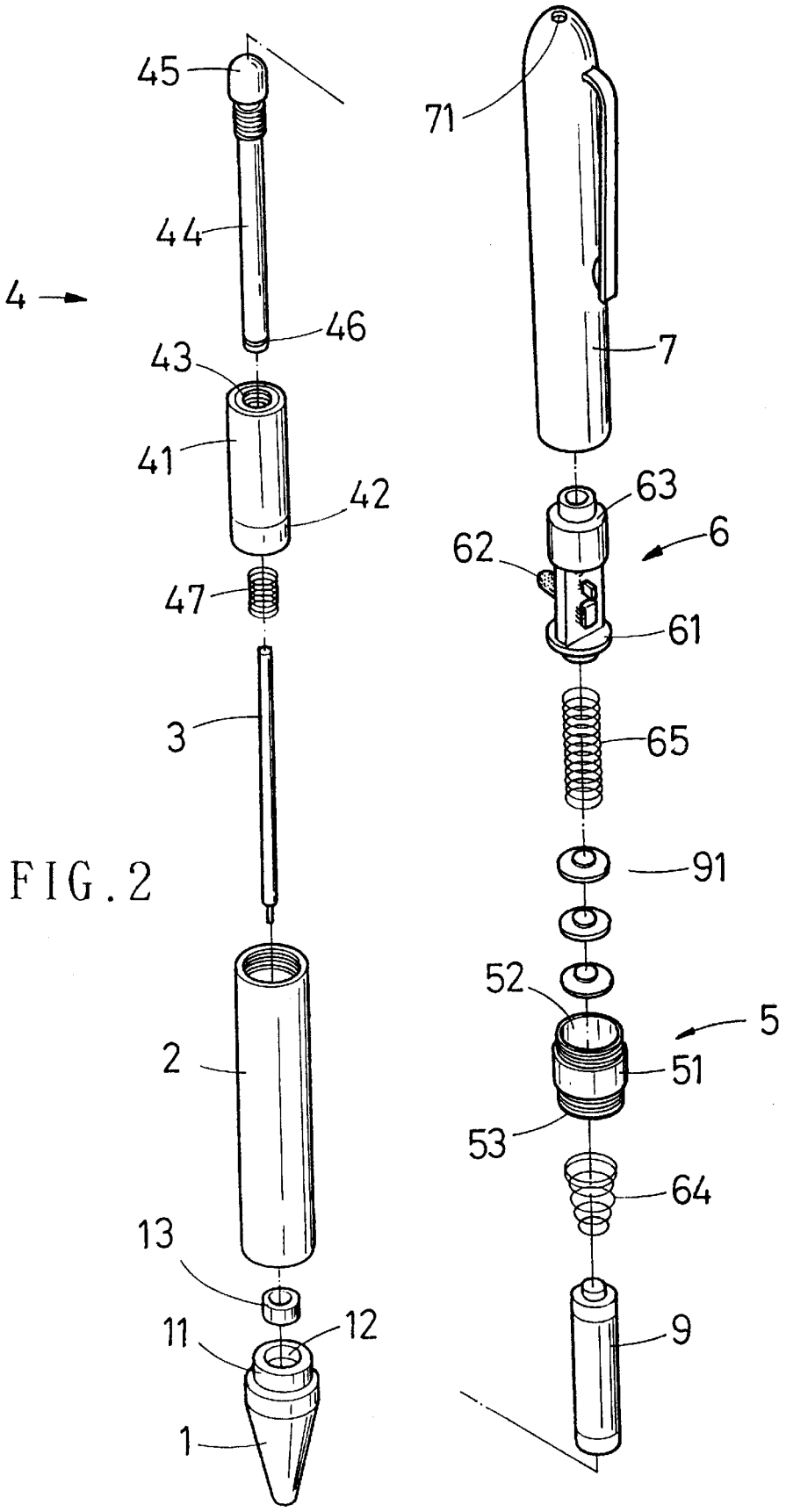
FIG. 2 is an exploded perspective of the pen with light-emitting means of the present invention.
Figure 3:
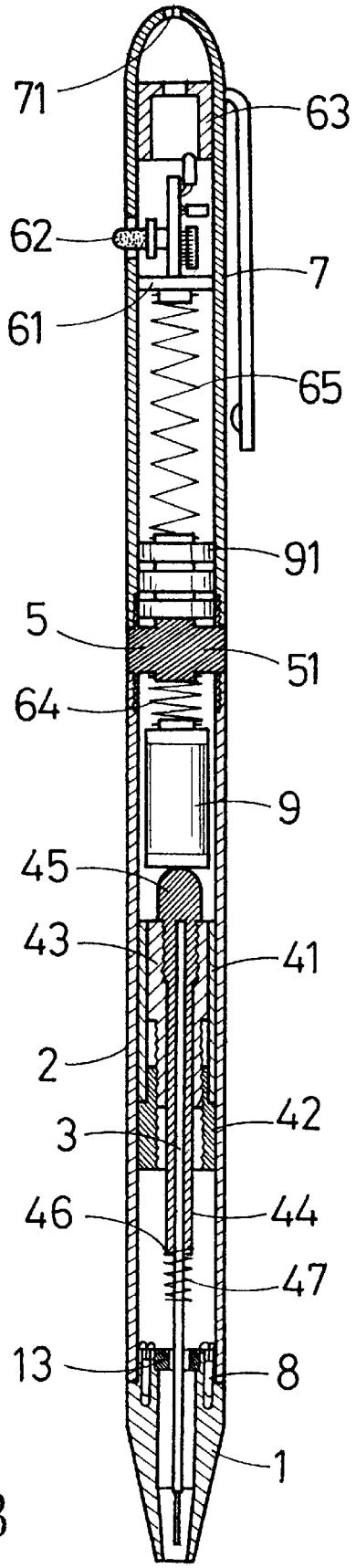
FIG. 3 is an assembled, sectional view of the pen with light-emitting means of the present invention.
Figure 5:
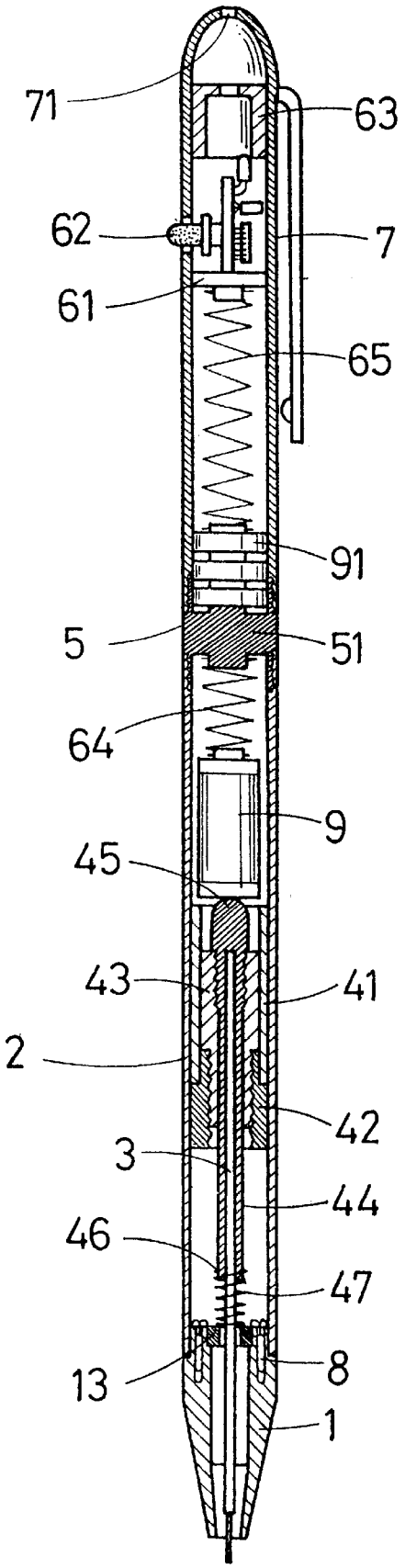
FIG. 5 is a sectional view illustrating the operation of the present invention.

Please now refer to FIGS. 2, 3 and 5 at the same time for the detailed assembling of the pen with light-emitting means A. The turning of the upper tube member 7 shall cause the hollow insulator 43 of the adjusting assembly 4 to axially move back and forth. This is because the upper tube member 7 has a lower end screwed to the ornamental ring 5 while the latter has a lower end screwed to a top end of the lower tube member 2 and the sleeve member 41 is mounted in the lower tube member in a tight fit relation, and thereby, turning of the upper tube member 7 shall cause the sleeve member 41 to idle at its same place. At this point, the internally threaded ring member 42 being tightly clamped to the lower end of the sleeve member 41 and engaged with the externally threaded lower end of the hollow insulator 43 shall be rotated by the idling sleeve member 41 and thereby causes the insulator 43 to axially move along the threads relative to the ring member 42. Furthermore, ribs and corresponding grooves (not shown) are provided on an upper outer periphery of the insulator 43 and an inner peripheral wall of the sleeve member 41, respectively, to facilitate the axial movement of the insulator 43 relative to the idling sleeve member 41. The axial movement of the insulator 43 further causes the ink tube holder 44 threaded to the upper end of the insulator 43 to axially move along with the insulator 43.

Since the ink tube 3 has an upper portion inserted into the ink tube holder 44 and is pressed by the hemispherical conductive body 45 on top of the holder 44 to stay in the holder 44, when the insulator 43 and the ink tube holder 44 axially moves downward due to the idling of the sleeve member 41, the ink tube 3 shall enter a retracted position. Since the conductive body 45 always contacts with the battery 9 due to a spring 64 disposed between the ornamental ring 5 and the battery 9, the downward movement of the ink tube holder 44 along with the insulator 43 in the adjusting assembly 4 shall cause the spring 47 having one end retained to the annular groove 46 at the lower end of the holder 44 to contact the conductive ring 13 disposed in the head member 1, and since the conductive ring 13 has an outer side contacting with the negative electrode wire 82 of the bulb 8, a close circuit is formed between the negative electrode wire of the bulb 8 and the battery 9. On the other hand, since an upper end of the battery 9 are electrically connected to the positive electrode wire 81 of the bulb 8 through the spring 64 disposed in the lower receiving space of the ornamental ring 5 which is screwed to the lower tube member 2, a complete circuit is formed and thereby causes the bulb 8 to light on.

As mentioned above, in the upper part of the pen with light-emitting means A, the spring 65 is disposed between another sets of batteries 91 and the base 61 of the IC board 6 to connect them. Batteries 91 are superposed on one another and are disposed in the top receiving space 52 of the ornamental ring 5. Sicne the ornamental ring 5 is screwed to the lower end of the upper tube member 7, batteries 91 in the top receiving space 52 of the ornamental ring 5 and the upper tube member 7 together form a close circuit. When the push-button switch 62 is depressed, the light source 66 on the circuit board 6 is caused to emit light which is focused by the focusing ring 63 above the circuit board 6 to form a light beam which is then emitted from the through hole 71 on the top of the upper tube member 7, serving as a light indicating means.

Figure 4:
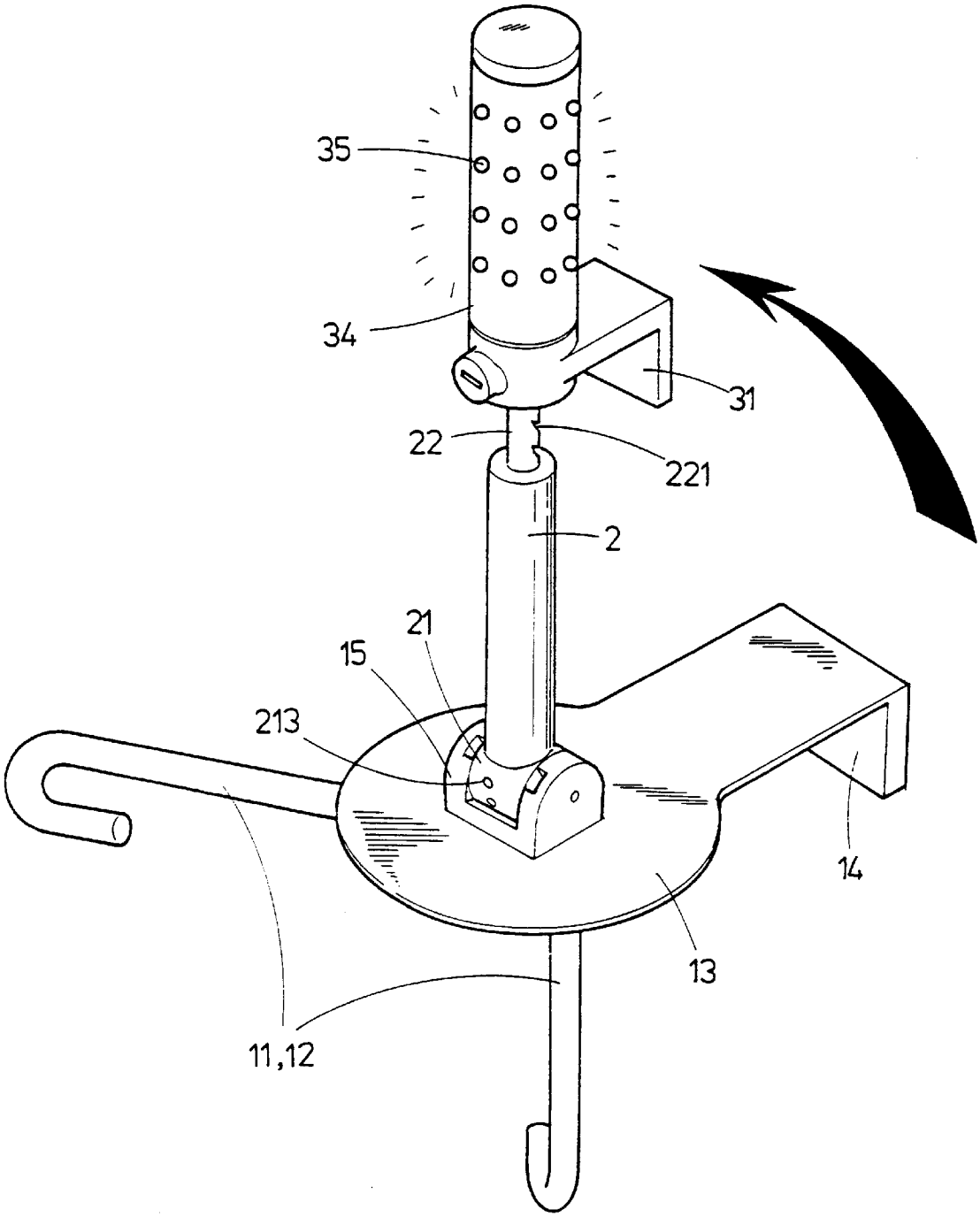
FIG. 4 is an enlarged, sectional view showing the head member of the pen with light-emitting means of the present invention.

As shown in FIG. 4, the conductive ring 13 has an outer periphery contacted with the negative electrode wire 82 of th bulb 8 to form a close circuit for the negative electrode wire of the bulb 8. On the other hand, the top end of the battery 9 is electrically connected to the positive electrode wire 81 of the bulb 8 through the spring 64 above the battery 9 and disposed in the bottom receiving space 53 of the ornamental ring 5, forming a complete circuit and thereby causes the bulb 8 to light on.

With the above arrangements, the pen according to the present invention can be used to write even in a place or at a time with poor light. Moreover, the pen of the present invention may emit light beam to serve as a light indicating means. To replace the batteries, simply turn the ornamental ring to disengage the upper tube member from the lower tube member. This may effectively prevent the connection between the adjusting assembly and the upper and the lower tube members from becoming loose due to frequent pull of the upper member off the lower tube member during the use of the pen A.

Although the present invention has been described with a preferred embodiment thereof, it should be noted that the present invention is not limited to such embodiment and that various changes can be made without departing from the spirit of the present invention or the scope of the subjoined claims.

What is claimed is:

1. A pen with light-emitting means comprises:

a head member formed of transparent material, said head member having a conic hollow lower portion and an upper retaining portion having a recess formed therein, said head member including a conductive ring disposed in said recess;

a light bulb disposed in an opening formed in said head and having a positive electrode wire and a negative electrode wire, said negative electrode wire contacting said conductive ring;

a lower tube member formed of metal and having a first end coupled to said upper retaining portion of said head member, said lower tube member contacting said positive electrode wire of said light bulb for making an electrical connection therewith;

an adjusting assembly disposed within said lower tube member, said adjusting assembly including (a) a longitudinally extended sleeve member, (b) a hollow insulator longitudinally displaceably disposed within said sleeve member, (c) an ink tube holder threadedly engaged with an upper end of said hollow insulator and extending therethrough, said ink tube holder having a hemispherically shaped conductive body formed on an upper end thereof and an opening formed in an opposing lower end, (d) a first spring coupled to a lower end of said ink tube holder, and (e) a first battery having one terminal thereof contacting said conductive body;

a non-conductive ink tube having one end disposed in said opening of said ink tube holder and an opposing end extending therefrom;

an insulative ring having a first end coupled to a second end of said lower tube member;

an upper tube member formed of metal and having a lower end coupled to a second end of said insulative ring;

a set of second batteries disposed in said upper tube adjacent said insulative ring;

a second spring disposed in said upper tube and having a first end contacting said second batteries; and, an IC board disposed in said upper tube and having a lower base portion contacting a second end of said second spring, said IC board including a focusing ring disposed adjacent an upper end of said upper tube member and a light source mounted on said IC board for directing light through said focusing ring.

2. The pen as recited in claim 1 where said ink tube holder has an annular groove formed adjacent said lower end thereof for retaining said first spring thereon, whereby said first spring contacts said conductive ring in said head member to close an electrical circuit with said light bulb responsive to a downward longitudinal displacement of said ink tube holder.

3. The pen as recited in claim 1 where said insulative ring defines an electrical separation between said light source in said upper tube member and said light bulb in said head member.

4. A pen with light-emitting means comprises:

a head member formed of transparent material, said head member having a conic hollow lower portion and an upper retaining portion having a first recess formed therein, said head member including a conductive ring disposed in said first recess, said upper retaining portion and said lower portion together forming a second recess;

a light bulb disposed in said second recess of said head, said light bulb having a positive electrode wire extending to an outer periphery of said upper retaining portion and a negative electrode wire extending to an inner side of said first recess;

a lower tube member formed of metal and having a first end coupled to said upper retaining portion of said head member, said lower tube member contacting said positive electrode wire of said light bulb for making an electrical connection therewith;

an adjusting assembly disposed within said lower tube member, said adjusting assembly including (a) a longitudinally extended sleeve member, (b) a hollow insulator longitudinally displaceably disposed within said sleeve member, (c) an ink tube holder threadedly engaged with an upper end of said hollow insulator and extending therethrough, said ink tube holder having a hemispherically shaped conductive body formed on an upper end thereof and an opening formed in an opposing lower end, (d) a first spring coupled to a lower end of said ink tube holder, and (e) a first battery having one terminal thereof contacting said conductive body;

a non-conductive ink tube having one end disposed in said opening of said ink tube holder and an opposing end extending therefrom;

an insulative ring having a first end coupled to a second end of said lower tube member;

an upper tube member formed of metal and having a lower end coupled to a second end of said insulative ring, said upper tube member having a through opening formed in an upper end thereof;

a set of second batteries disposed in said upper tube adjacent said insulative ring;

a second spring disposed in said upper tube and having a first end contacting said second batteries; and, an IC board disposed in said upper tube and having a lower base portion contacting a second end of said second spring, said IC board including a focusing ring disposed adjacent an upper end of said upper tube member and a light source mounted on said IC board for directing light through said focusing ring.

5. The pen as recited in claim 4 further comprising a third spring disposed within said lower tube member between said first battery and insulative ring for electrically coupling another terminal of said first battery to said positive electrode wire through said lower tube member, said negative electrode wire contacting said conductive ring and a closed circuit being formed to illuminate said light bulb responsive to a downward longitudinal displacement of said ink tube holder.

6. The pen as recited in claim 4 where said IC board includes a switch having a push button extending through an aperture formed in said upper tube member, whereby depression of said push button closes a circuit for energizing said light source to emit a beam of light through said through opening of said upper tube member.

* * * * *